US005252886A

United States Patent [19]

Renardus et al.

[11] Patent Number: 5,252,886

[45] Date of Patent: Oct. 12, 1993

[54] HIGH-PRESSURE DISCHARGE LAMP WITH CERAMIC VESSEL

[75] Inventors: Max L. P. Renardus; Theodorus P. P. Kandelaars, both of Eindhoven, Netherlands; Samuel A. Carleton; Cornelis A. J. Jacobs, both of Turnhout, Belgium

[73] Assignee: U.S. Philips Corporation, New York, N.Y.

[21] Appl. No.: 865,530

[22] Filed: Apr. 9, 1992

[30] Foreign Application Priority Data

Apr. 16, 1991 [EP] European Pat. Off. ..... 91200890.1

[51] Int. Cl.[5] ..... H01J 5/02; H01J 61/30; H01J 61/52

[52] U.S. Cl. ..... 313/44; 313/45; 313/634

[58] Field of Search ..... 313/44, 634, 45

[56] References Cited

U.S. PATENT DOCUMENTS

| | | | |
|---|---|---|---|
| D. 198,268 | 5/1964 | Thorington et al. | 313/634 X |
| 1,589,927 | 6/1926 | Beattie | 313/44 |
| 3,622,910 | 11/1971 | Kantrowitz et al. | 313/634 X |
| 4,825,125 | 4/1989 | Lagushenko et al. | 313/634 X |
| 4,970,431 | 11/1990 | Vegter et al. | 313/634 |

FOREIGN PATENT DOCUMENTS

| | | | |
|---|---|---|---|
| 1223985 | 6/1960 | France | 313/44 |
| 148860 | 11/1980 | Japan | 313/45 |

*Primary Examiner*—Palmer C. Demeo
*Attorney, Agent, or Firm*—Brian J. Wieghaus

[57] ABSTRACT

The high pressure discharge lamp has an elongate discharge vessel of ceramic material. The outside surface area of the wall of the discharge vessel is strongly increased by a relief. Since a higher heat flow from the discharge vessel to the environment is possible, the lamp can withstand a higher load. In this way, lamp properties such as luminous flux, color rendering index and/or color temperature can be improved.

20 Claims, 2 Drawing Sheets

HIGH-PRESSURE DISCHARGE LAMP WITH CERAMIC VESSEL

BACKGROUND OF THE INVENTION

The invention relates to a high-pressure discharge lamp comprising an elongate discharge vessel which is sealed in a vacuumtight manner, has a wall of ceramic material, and is provided with an ionizable filling and with a first and a second electrode which are arranged at respective ends of the discharge vessel and which are each connected to a respective current supply conductor which issues through the wall of the discharge vessel to the exterior, which discharge vessel is provided with cooling means.

Such a high-pressure discharge lamp is known from EP 0 315 261. By ceramic material is meant a refractory material such as monocrystalline metal oxides, for example sapphire, polycrystalline metal oxides, for example translucent, gastight sintered aluminium oxide or yttrium oxide, or non-oxidic materials such as aluminium nitride. The filling of the discharge vessel may comprise metals such as mercury or sodium, or metal halides such as iodides of Na, Tl, In, Sc, and/or the rare earth metals.

The known lamp has cooling means consisting of a separate, radially extending moulded piece which is in mechanical contact with the discharge vessel. The cooling means contribute to the possibility of a higher load, and thus of a higher power dissipation. Lamp characteristics, such as luminous flux, color rendering, and/or color temperature can be improved thereby compared with a similar lamp without the said cooling means.

A drawback of the known lamp is that separate moulded pieces are to be manufactured, which renders the lamp construction more complicated. In addition, narrow tolerances are to be observed. On the one hand, there is the risk of heat transport from the discharge vessel to the surrounding being limited owing to the fact that the moulded piece is too large for the discharge vessel. On the other hand, rejects may occur because the moulded piece is too small for being assembled together with the discharge vessel, or it may induce inadmissible mechanical strain during lamp operation.

SUMMARY OF THE INVENTION

The invention has for its object inter alia to provide a high-pressure discharge lamp of the kind described in the opening paragraph which is easy to manufacture and in which the risk of a bad heat transfer to the surroundings is avoided, while rejects are limited.

According to the invention, this object is achieved in that the cooling means are formed by recesses which form a substantially regular external relief in the wall of the discharge vessel, and in that this relief is situated at least at a portion of the discharge vessel wall located between the electrodes and extends over the entire circumference of the discharge vessel.

The surface area of the wall is increased by the recesses in the wall, so that the discharge vessel can give off more heat by radiation. Not only is a separate moulded piece unnecessary for the lamp according to the invention and are fewer assembly operations sufficient, the tolerances for the dimensions of the discharge vessel may also be wider. In addition, there is a reliable heat transfer to the surroundings since the cooling means are integral with the discharge vessel and do not consist of a separate moulded piece.

It is noted that it is known to increase the cooling capacity of a discharge vessel by increasing the wall thickness, and thus the exterior surface area of the wall. A disadvantage of a greater wall thickness, however, is that the surface area of a cross-section of the discharge vessel is greater, so that the heat transport in longitudinal direction increases considerably during lamp operation. As a result, the temperature near the ends of the discharge vessel is higher in the case of the same temperature of the wall between the electrodes. This can lead to inadmissible mechanical strain between the current supply conductors and the discharge vessel. The cost price of such a lamp is higher because more ceramic material is required for the discharge vessel.

The exterior surface area of the wall is considerably increased through the provision of a relief in the wall of the discharge vessel of the lamp according to the invention without the surface area of the cross-section of the wall increasing. As a result, a lamp according to the invention can dissipate a greater power at the same longitudinal temperature distribution of the discharge vessel between the electrodes than a high-pressure discharge lamp without relief. By giving discharge vessels a relief of a suitable shape and size, it is possible to realise a class of lamps which comprises both lamps suitable for dissipating comparatively low powers and lamps suitable for comparatively high powers, all of which have a discharge vessel of substantially the same length.

It is noted that GB 1 401 293 discloses lamps with a discharge vessel which is unround for optical reasons. In this Patent, no suggestion is made to improve the heat transfer from the discharge vessel to the surroundings. Neither are the lamps, of which cross-sections are shown, suitable for comparatively high loads. It is true that this Patent shows an embodiment with a discharge vessel provided with two reliefs at the outside, but these reliefs are meant to obtain a beam concentration of the emitted radiation and together enclose an angle around the discharge vessel of no more than approximately 180°. A large portion of the circumference of the discharge vessel, accordingly, has no relief. The heat transfer from the discharge vessel to the surroundings is very unevenly distributed, therefore, so that the temperature around the discharge vessel in a cross-section thereof is not the same everywhere. This involves the risk of mechanical stresses in the discharge vessel, while the lamp characteristics may be adversely affected. By contrast, the relief in a lamp according to the invention, at least in a portion of the discharge vessel wall situated between the electrodes, is present over the entire circumference of the discharge vessel, so that the spread in temperature is limited and inadmissible stresses upon thermal loading are avoided.

In a lamp according to the invention, the relief is present at least over a portion of the discharge vessel wall situated between the electrodes since the thermal load is highest there. The wall thickness in the portion not provided with a relief may correspond, for example, to the wall thickness of the discharge vessel in the recesses, or alternatively, for example, to the wall thickness between the recesses. It may be advantageous, however, for the relief to extend further, for example, to beyond the electrodes or even over the entire exterior of the discharge vessel wall. In fact, a very even temperature distribution over the discharge vessel may then be obtained. Preference is given therefore to a lamp according to the invention which is characterized in that the relief extends to beyond the electrodes.

A regular relief is used in a lamp according to the invention, i.e. the recesses are regularly distributed over the exterior of the discharge vessel wall. An even cooling can be obtained thereby.

If a desired, for example, very small temperature gradient over the discharge vessel wall is to be obtained, it may be desirable to use a regularly progressive relief, for example, whereby the pitch of the recesses increases or decreases regularly from the centre to the ends of the discharge vessel over the length of the discharge vessel.

The relief may have grooves which run in random directions. In a favourable embodiment, the recesses comprise continuous transversal grooves. Longitudinal stresses in the discharge vessel are avoided by these transversal grooves. This contributes to the discharge vessel being capable of withstanding higher thermal loads. A discharge vessel having transversal grooves may be readily manufactured in that the discharge vessel is rotated and a rotating set of diamond saws is pressed against it.

In a further attractive embodiment, the recesses comprise longitudinal grooves. Such grooves are readily obtained if the discharge vessel is manufactured by extrusion. In a favourable modification, the discharge vessel has both longitudinal and transversal grooves. The discharge vessel may then have a very large exterior surface area.

In another advantageous embodiment, the recesses are wells having a depth and a maximum diameter, the depth being at least three times the maximum diameter. Since such wells behave approximately as black bodies, a high heat transfer by radiation may be achieved.

In a very advantageous embodiment, the discharge vessel is included in an outer bulb which is filled with gas, for example with nitrogen gas. The discharge vessel can then give off heat to the surroundings not only through radiation, but also through convection.

BRIEF DESCRIPTION OF THE DRAWINGS

These other aspects of the high-pressure discharge lamp according to the invention are explained with reference to the drawings, in which.

DESCRIPTION OF THE PREFERRED EMBODIMENTS

Figure 1:
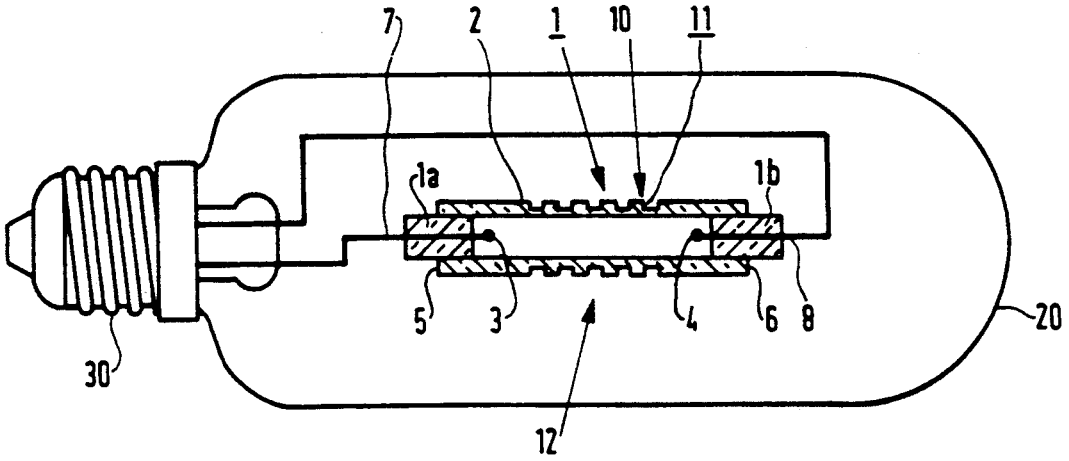
FIG. 1 shows an embodiment of a high-pressure discharge lamp, partly in side elevation and partly in cross-section.

The high-pressure discharge lamp shown in FIG. 1 has an elongate discharge vessel 1 which is sealed in a vacuumtight manner and has a wall 2 of translucent, gastight sintered polycrystalline alumina (PCA). The discharge vessel 1 is provided with an ionizable filling and with electrodes 3, 4 which are arranged at the ends 5, 6 of the discharge vessel 1. The electrodes 3, 4 are connected to current supply conductors 7, 8 which issue through the wall 2 of the discharge vessel 1 to the exterior. The discharge vessel 1 is provided with cooling means 10. In the embodiment shown, the discharge vessel 1 is sealed at the ends 5, 6 by means of tubes 1*a*, 1*b* of, for example, PCA, which are sealed-in in a vacuumtight manner and which project from the discharge vessel 1. Alternatively, the tubes 1*a*, 1*b* may be constructed as short plugs which are entirely enclosed in the discharge vessel 1. Instead of by sealing-in, the connection between the tubes 1*a*, 1*b* and the discharge vessel 1 may also be obtained by sintering together.

The cooling means 10 are formed by recesses 11 which form a relief 12 at the outside of the wall 2 of the discharge vessel 1, which relief extends over a portion of the wall 2 situated between the electrodes 3, 4 in the embodiment shown and which extends over the entire circumference of the discharge vessel 1. The discharge vessel 1 is included in an outer bulb 20 filled with nitrogen and the lamp has an Edison lamp cap 30.

Figure 2:
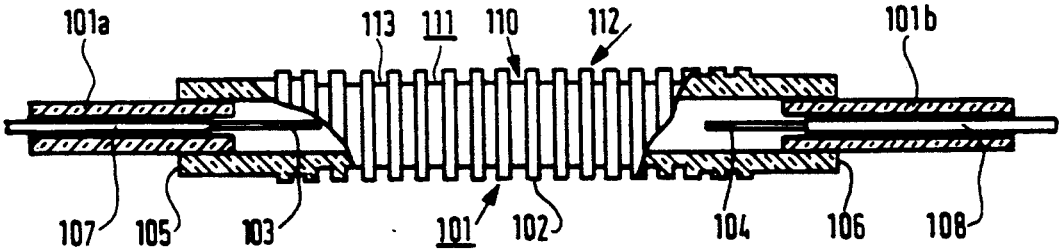
FIG. 2 shows the discharge vessel of a second embodiment of a high-pressure discharge lamp, partly in elevation and partly in longitudinal section.

In FIG. 2, parts corresponding to those in FIG. 1 have reference numerals which are 100 higher. In the embodiment shown, the recesses 111 are continuous transversal grooves 113, and the relief 112 formed thereby extends to beyond the electrodes 103, 104. The discharge vessel 101 is shown partly broken away for greater clarity.

Figure 3:
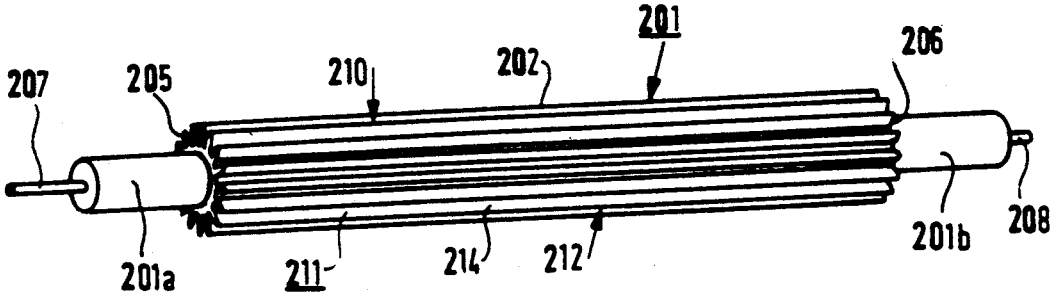
FIG. 3 shows a third embodiment of the discharge vessel of a high-pressure discharge lamp in perspective view.

In FIG. 3, parts corresponding to those of FIG. 2 have reference numerals which are 200 higher. In this embodiment, the recesses 211 are longitudinal grooves 214. The relief 212 extends over the entire exterior of the wall 202 of the discharge vessel 201.

Figure 4:
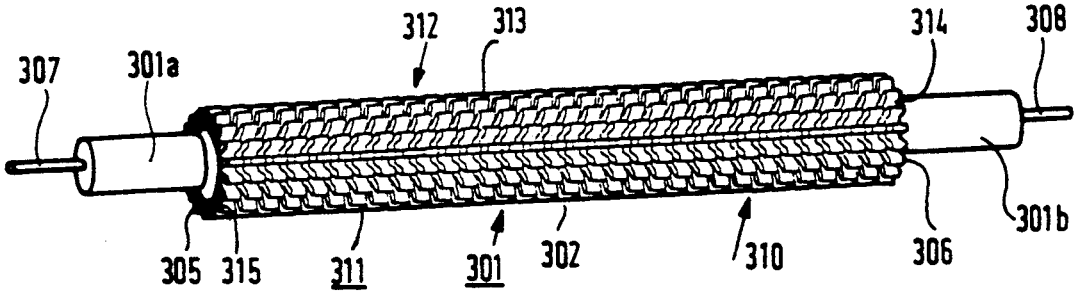
FIG. 4 shows a fourth embodiment of the discharge vessel of a high-pressure discharge lamp in perspective view.

In FIG. 4, parts corresponding to those of FIG. 2 have reference numerals which are 300 higher. In this embodiment, the recesses 311 consist of both longitudinal and continuous transversal grooves (314 and 313, respectively). Owing to this combination of grooves 313, 314, the exterior of the wall 302 of the discharge vessel 301 has a relief of spines 315.

Figure 5:
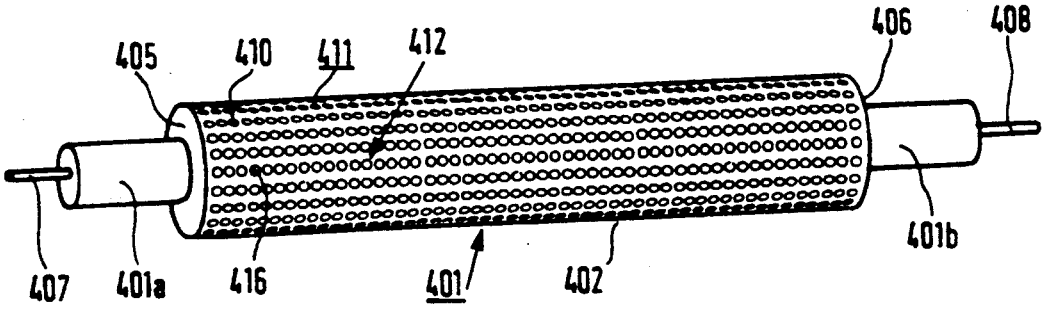
FIG. 5 shows a fifth embodiment of the discharge vessel of a high-pressure discharge lamp, also in perspective view.

In FIG. 5, parts corresponding to those of FIG. 2 have reference numerals which are 400 higher. Here the recesses 411 are wells 416 having a depth and a maximum diameter, the depth being at least three times the maximum diameter.

The lamp characteristics were measured of high-pressure sodium lamps having discharge vessels as shown in FIG. 3, both with vacuum outer bulbs and with nitrogen-filled outer bulbs, and compared with those of lamps having conventional discharge vessels. The ionizable filling consisted of 22.5 mg of a sodium-mercury amalgam in a weight ratio of 8.3/40, and xenon with a pressure of 1400 mbar at room temperature. The lamps were so adjusted that the luminous efficacy was at its maximum. The surface area of the cross-section of the discharge vessel was 19.8 $mm^2$ in all cases. A summary of the relevant dimensions of the lamps is given in Table 1. The lamp characteristics and the settings at which a maximum luminous efficacy was realised are given in Table 2. In this Table, $P_{la}$ is the power dissipated by the lamp in W, $V_{la}$ the effective voltage across the lamp in V, $I_{la}$ the effective current through the lamp in A, $\phi$ the total luminous flux in Lm, $\eta_{la}$ the luminous efficacy of the lamp in lm/W, and $T_w$ the temperature of the hottest spot of the discharge vessel wall in K. This temperature can be determined by spectroscopy. The Table in addition shows the power $P_{la}$ (max) dissipated by the lamp for which the highest temperature at the inside of the wall is 1550 K; this temperature is regarded as critical for the gastight sintered aluminum oxide used as the wall material. It is apparent from Table 2 that an increase in the power dissipated by the lamp is possible and that the luminous efficacy is increased owing to the use of a relief in the discharge vessel wall. The result of this is that a higher luminous flux can also be realised. An even greater improvement in the luminous efficacy is possible if the outer bulb is filled with gas.

TABLE 1

| | Conventional | With relief |
|---|---|---|
| Inner diameter | 3.8 mm | |
| Discharge vessel length | 51 mm | |
| Tip-bottom distance | 9.5 mm | |
| Relief depth | — | 1.5 mm |
| Relief recurrence | — | 0.64 $mm^{-1}$ |
| Exterior diameter | 6.3 mm | 8.0 mm |

TABLE 2

| | Outer bulb: vacuum | | Outer bulb: 950 mbar $N_2$ | |
|---|---|---|---|---|
| | Conventional | With relief | Conventional | With relief |
| $P_{la}$ (W) | 96.0 | 131.0 | 175 | 207.7 |
| $V_{la}$ (V) | 84.4 | 81.4 | 80.3 | 79.0 |
| $I_{la}$ (A) | 1.337 | 1.865 | 2.424 | 3.016 |
| $\phi$ (lm) | 10006 | 14008 | 20116 | 24838 |
| $\eta_{la}$(lm/W) | 104.2 | 106.9 | 114.9 | 119.6 |
| $T_w$ (K) | 1366 | 1388 | 1442 | 1420 |
| $P_{la}$(max)(W) | 163 | 188 | 225 | 277 |

We claim:

1. A high-pressure discharge lamp comprising an elongate discharge vessel sealed in a vacuumtight manner and having a tubular wall of ceramic material, said wall including a smoothly extending cylindrical inner surface and an outer surface, an ionizable filling within the discharge vessel, first and second discharge electrodes arranged at respective ends of the discharge vessel and between which an arc discharge is maintained during lamp operation, a respective current supply conductor connected to each discharge electrode which issues through the wall of the discharge vessel to the exterior, and cooling means for cooling the discharge vessel, characterized in that:

the cooling means include recesses in the outer surface of the discharge vessel which form a substantially regular external relief in the wall of the discharge vessel, and in that this relief is situated at least at a portion of the discharge vessel wall located between the electrodes and extends over the entire circumference of the discharge vessel.

2. A high-pressure discharge lamp as claimed in claim 1, characterized in that the relief extends to beyond the electrodes.

3. A high-pressure discharge lamp as claimed in claim 2, characterized in that the discharge vessel is included in an outer bulb which is filled with gas.

4. A high-pressure discharge lamp as claimed in claim 2, characterized in that the recesses comprise longitudinal grooves.

5. A high-pressure discharge lamp as claimed in claim 4, characterized in that the discharge vessel is included in an outer bulb which is filled with gas.

6. A high-pressure discharge lamp as claimed in claim 2, characterized in that the recesses comprise continuous transversal grooves.

7. A high-pressure discharge lamp as claimed in claim 6, characterized in that the recesses comprise longitudinal grooves.

8. A high-pressure discharge lamp as claimed in claim 2, characterized in that the discharge vessel is included in an outer bulb which is filled with gas.

9. A high-pressure discharge lamp as claimed in claim 6, characterized in that the discharge vessel is included in an outer bulb which is filled with gas.

10. A high-pressure discharge lamp as claimed in claim 2, characterized in that the recesses are wells having a depth and a maximum diameter, the depth being at least three times the maximum diameter.

11. A high-pressure discharge lamp as claimed in claim 10, characterized in that the discharge vessel is included in an outer bulb which is filled with a gas.

12. A high-pressure discharge lamp as claimed in claim 1, characterized in that the discharge vessel is included in an outer bulb which is filled with gas.

13. A high-pressure discharge lamp as claimed in claim 1, characterized in that the recesses are wells having a depth and a maximum diameter, the depth being at least three times the maximum diameter.

14. A high-pressure discharge lamp as claimed in claim 13, characterized in that the discharge vessel is included in an outer bulb which is filled with gas.

15. A high-pressure discharge lamp as claimed in claim 1, characterized in that the recesses comprise longitudinal grooves.

16. A high-pressure discharge lamp as claimed in claim 15, characterized in that the discharge vessel is included in an outer bulb which is filled with gas.

17. A high-pressure discharge lamp as claimed in claim 1, characterized in that the recesses comprises continuous transversal grooves.

18. A high-pressure discharge lamp as claimed in claim 17, characterized in that the recesses comprise longitudinal grooves.

19. A high-pressure discharge lamp as claimed in claim 18, characterized in that the discharge vessel is included in an outer bulb which is filled with gas.

20. A high-pressure discharge lamp as claimed in claim 17, characterized in that the discharge vessel is included in an outer bulb which is filled with gas.

* * * * *